US008250950B2

(12) United States Patent
Cluthe

(10) Patent No.: US 8,250,950 B2
(45) Date of Patent: Aug. 28, 2012

(54) MULTIPLE-BIT HAND TOOL WITH LOCKING AXIAL POST

(75) Inventor: Gary P. Cluthe, Waterloo (CA)

(73) Assignee: Duron Plastics Limited, Kitchener, ON (CA)

( * ) Notice: Subject to any disclaimer, the term of this patent is extended or adjusted under 35 U.S.C. 154(b) by 0 days.

(21) Appl. No.: 12/513,877

(22) PCT Filed: Jan. 3, 2008

(86) PCT No.: PCT/CA2008/000005

§ 371 (c)(1),
(2), (4) Date: May 7, 2009

(87) PCT Pub. No.: WO2008/080230

PCT Pub. Date: Jul. 10, 2008

(65) Prior Publication Data

US 2010/0242689 A1 Sep. 30, 2010

Related U.S. Application Data

(60) Provisional application No. 60/883,361, filed on Jan. 4, 2007.

(51) Int. Cl.
*B25B 23/00* (2006.01)
*B25G 1/08* (2006.01)

(52) U.S. Cl. ..... 81/439; 81/177.4

(58) Field of Classification Search ..... 81/439, 81/490, 437, 440, 177.4; 401/31
See application file for complete search history.

(56) References Cited

U.S. PATENT DOCUMENTS 1,816,812 A 8/1931 Allison (Continued)

FOREIGN PATENT DOCUMENTS

WO 2005051607 5/2005

OTHER PUBLICATIONS

PCT International Searching Authority, International Search Report and Written Opinion for International App. No. PCT/CA2008/000005, Apr. 21, 2008.

(Continued)

*Primary Examiner* — Hadi Shakeri
(74) *Attorney, Agent, or Firm* — Borden Ladner Gervais LLP; Jeffrey W. Wong

(57) ABSTRACT

The hand tool (1) has a body (7), and a chuck (4) with an axial opening (3) on an axis of the tool. A tool element (2) is movable between a retracted position generally within the body, and an extended operative position wherein the tool element extends through the axial opening and chuck, the chuck having a stop (15) for blocking further extension of the tool element once in its operative position. A movable means (16) blocks the tool element against retraction when in the operative position, the movable means being dislodgeable when retraction is desired, to a position where the movable means no longer blocks the tool element against retraction. In the preferred embodiment, the hand tool has multiple tool elements (six for example), spaced around the axis of the tool. Each tool element, when extended, has a proximal end which abuts the distal end (14) of an axial post in the handle of the tool. The actuation mechanism (5, 8, 9, 10), in addition to moving the tool elements axially, preferably provides means (9, 10) for moving the distal end of the axial post radially, i.e. Away from axis and the tool element, for retraction of the tool element.multiple-bit hand tool with locking axial post.

8 Claims, 5 Drawing Sheets

U.S. PATENT DOCUMENTS

| | | | | |
|---|---|---|---|---|
| 5,337,637 | A | 8/1994 | Bih-Lien | |
| 5,526,721 | A | 6/1996 | Waisvisz | |
| 6,205,893 | B1 * | 3/2001 | Sato | 81/439 |
| 6,332,384 | B1 | 12/2001 | Cluthe | |
| 7,086,314 | B2 * | 8/2006 | Wannop | 81/490 |
| 7,275,466 | B2 * | 10/2007 | Cluthe | 81/439 |
| 7,334,508 | B2 * | 2/2008 | Heaven | 81/440 |
| 7,665,391 | B2 * | 2/2010 | Beauchamp | 81/439 |
| 2002/0007705 | A1 | 1/2002 | Beauchamps | |
| 2004/0065177 | A1 | 4/2004 | Wannop | |
| 2005/0045002 | A1 | 3/2005 | Cluthe | |
| 2007/0221017 | A1 | 9/2007 | Heaven | |

OTHER PUBLICATIONS

New Zealand Intellectual Property Office, Examination Report for NZ Patent App. No. 577972, Jan. 31, 2011.

Canadian Intellectual Patent Office, Office Action for Candian Patent App. No. 2,669,474, May 5, 2011.

European Patent Office, Supplementary European Search Report for EP Patent App No. 08700487.5, Aug. 3, 2011.

European Patent Office, European Examination Report for EP Patent App No. 08700487.5, Mar. 27, 2012.

* cited by examiner

MULTIPLE-BIT HAND TOOL WITH LOCKING AXIAL POST

BACKGROUND OF THE INVENTION

The invention relates to a hand tool having multiple bits or other tool elements selectable for use one at the time. The bits or tool elements are movable between a retracted storage position within the handle of the tool, and an extended operative position.

The hand tool is normally a screwdriver. However, while the words "screwdriver" and "bits" are used for convenience throughout this description, it should be understood that these words are intended to be interpreted liberally, and thus could include hand tools with such tool elements as pen/pencil or scribing tips, hex keys, or other items other than screwdriver bits.

The invention is particularly directed towards a mechanism for automatically locking the tool elements in their operative position, when extended to that position, and for readily unlocking the tool elements when retraction is desired.

SUMMARY OF THE INVENTION

It is an object of the invention to provide a hand tool or screwdriver of the general type referred to above, but having a suitable means for automatically locking the bits or tool elements in their operative position, once extended to that position, and a suitable means for readily unlocking the tool elements when retraction is desired.

In the invention, the hand tool has a body, and a chuck with an axial opening on an axis of the tool. A tool element is movable between a retracted position generally within the body, and an extended operative position wherein the tool element extends through the axial opening and chuck, the chuck having a stop for blocking further extension of the tool element once in its operative position. A movable means blocks the tool element against retraction when in the operative position, the movable means being dislodgeable when retraction is desired, to a position where the movable means no longer blocks the tool element against retraction.

In the preferred embodiment, the hand tool has multiple tool elements (six for example), spaced around the axis of the tool. Each tool element, when extended, has a proximal end which abuts the distal end of an axial post in the handle of the tool. The axial post is somewhat flexible, away from the axis of the tool, as will be explained in more detail below. A forward stop in the chuck blocks the tool element from extending too far, and the axial post prevents the tool element from retracting, so the tool element is essentially locked in place axially between the forward stop and the distal end of the axial post. Locking against rotational movement is achieved by providing the axial opening with a cross-sectional shape (hexagonal for example) corresponding to the cross-sectional shape of the tool element.

The actuation mechanism, in addition to moving the tool elements axially, preferably provides means for moving the distal end of the axial post radially, i.e. away from axis and the tool element, for retraction of the tool element. When the actuation mechanism is operated to move the tool element all the way forward, the resilience of the axial post urges the axial post either fully or partially into alignment with the proximal end of the tool element, blocking it against retraction. When the actuation mechanism is operated to retract the tool element, the axial post is displaced from the axis of the tool to permit retraction.

Further features will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE INVENTION

The invention will now be described in detail, with reference to the accompanying drawings.

Figure 1:
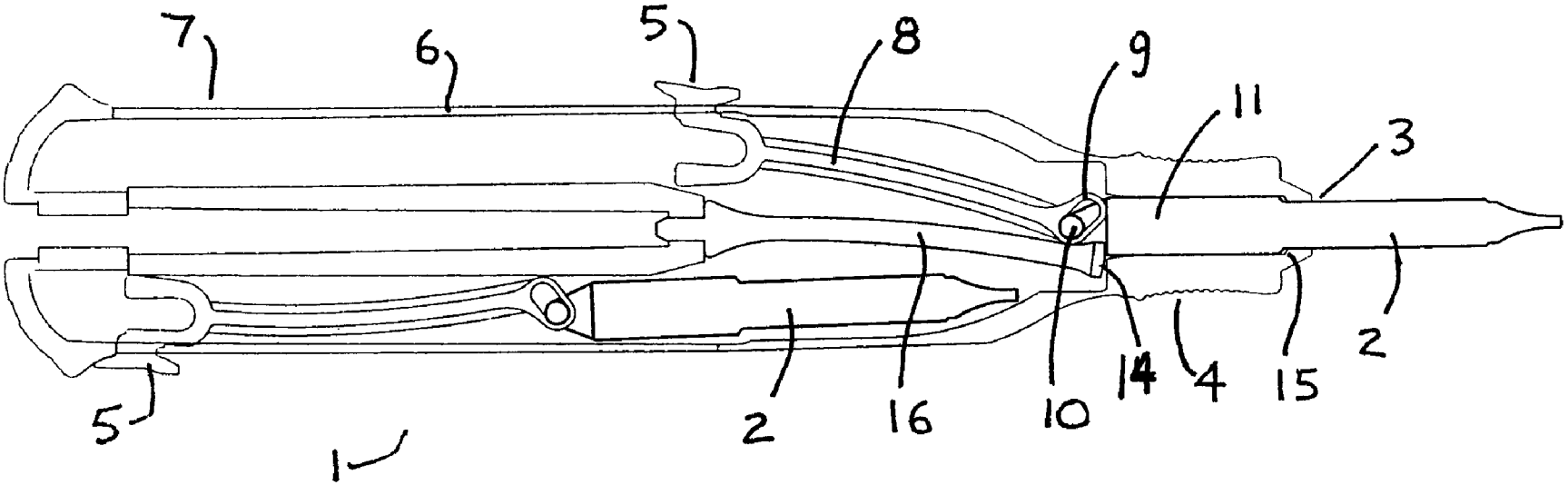
FIG. 1 is a cross-sectional view of the hand tool, with the actuator fully forward and a tool element thus locked in place by the axial post.
Figure 2:
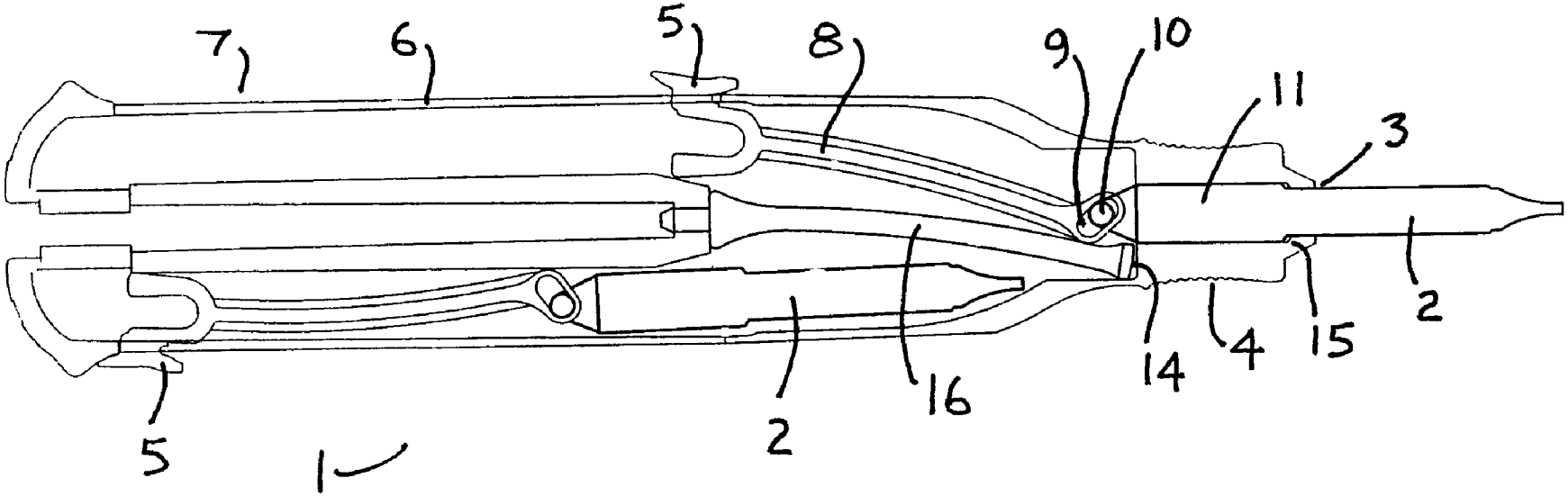
FIG. 2 is a corresponding cross-sectional view, with the actuator starting to retract, and the distal end of the axial post thereby being kicked out of engagement with the proximal end of the tool element.
Figure 3:
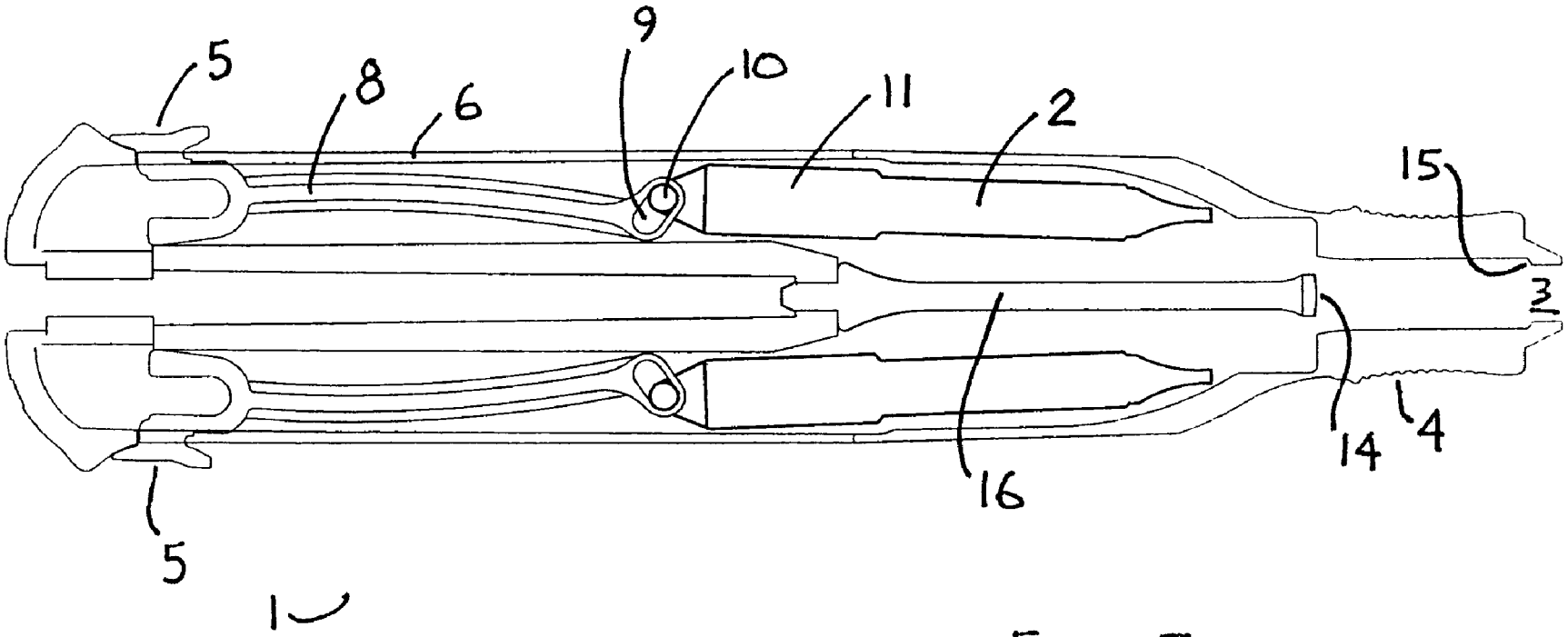
FIG. 3 is a corresponding cross-sectional view with all tool elements fully retracted.

FIGS. 1 to 3 show the preferred embodiment of the multiple bit hand tool 1 of the invention. Tool elements 2 are extended and retracted through a central opening 3 in a chuck 4 by manipulation of actuation means, namely actuator buttons 5, which are slidable along slots 6 in the body or handle 7. The buttons 5 have preferably integral actuation arms 8, with angled slots 9 at their distal ends. The angled slots engage pins 10 on the proximal end of bit holders 11, the bit holders in this case constituting part of the tool elements together with bits mounted in the distal end thereof.

The chuck 4 in this invention does not have any axial locking means for the tool elements, but does prevent rotation of the tool elements by virtue of its central opening 3 and/or the main body portion of the chuck 4 having a cross-section (hexagonal for example) corresponding dimensionally to the cross-section of the tool elements.

As can be seen in FIG. 1, an extended tool element is locked in its operative position by being trapped between a forward stop surface 15 of the chuck, and movable means such as the distal end 14 of the axial post 16. proximal end which abuts the distal end of a center (axial) post in the handle. The axial post is somewhat flexible and resilient, biased towards the axis of the tool.

FIG. 2 shows the actuator button starting to be retracted. By virtue of the angled slot 9, the distal end of the actuation arm 8 is forced sideways as it retracts, thereby displacing the axial post laterally, so as to disengage the tool element.

FIG. 3 shows the actuator button, actuation arm and tool element fully retracted, with the axial post in its central resting position.

As can be appreciated from FIGS. 1 and 2, when an actuator button is moved forward to extend a tool element, the angled slot 9 is forced away from the axis of the tool, thereby allowing the resilience of the axial post to move the axial post into position to block retraction of the tool element.

It will be appreciated that the above description relates to the preferred embodiments by way of example only. Many variations on the invention will be obvious to those knowledgeable in the field, and such obvious variations are within the scope of the invention as described and claimed, whether or not expressly described. For example, the size of the hand tool may be varied to suit different applications such as pocket screwdrivers or higher torque screwdrivers. Screwdriver bits may be replaced by a pen/pencil or scribing tip, or other non-screwdriver bits, which are retractable into the housing similar to the screwdriver bits described above. The most common application of the invention will be as a screwdriver, with the elements being screwdriver bits, but the invention is not limited to that.

Figure 4:
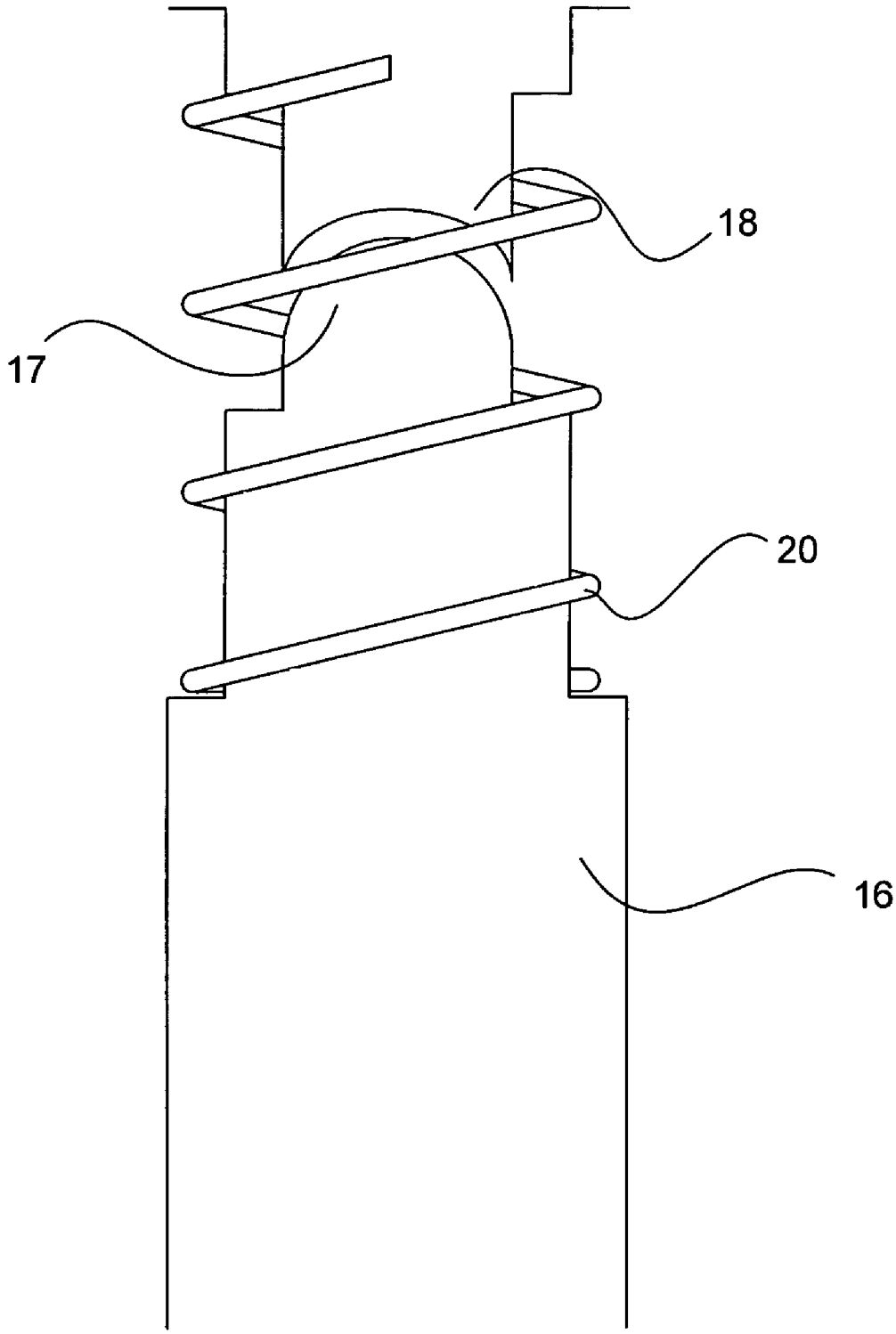
FIG. 4 is a sketch of an alternative embodiment of the axial post.

One particular possible variation is that the axial post, instead of being resilient, could be of rigid construction, but pivotally mounted at its proximal end, and spring-biased towards the axis of the tool, to achieve the same result. FIG. 4 is a sketch illustrating one possible way in which this could be achieved, i.e. with the axial post 16 having a rounded end 17 pivoting in a socket 18, held in place and biased axially by a spring 20. Essentially, as long as the distal end of the axial post is somehow suitably biased towards the axis of the tool, the mechanism will work.

Figure 5:
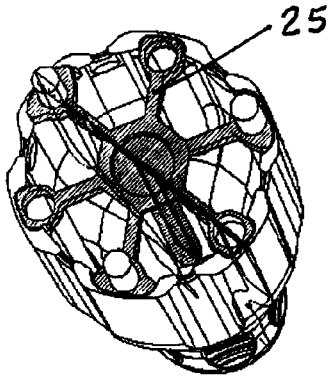
FIG. 5 is a perspective view of one option for the axial post installation.
Figure 6:
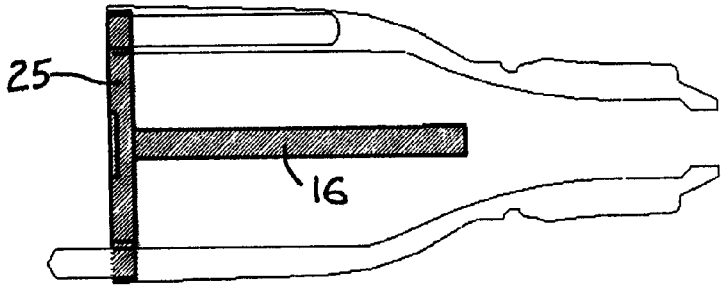
FIG. 6 is a corresponding cross-section.

FIGS. 5 and 6 illustrate one way in which the axial post could be installed, though obviously the invention is not limited to this specific configuration. In this example, a support element 25 is positioned between two halves of the tool handle, spanning across the handle laterally, and the axial post 16 extends from it.

The invention claimed is:

1. A hand tool having a body, and a chuck with an axial opening on an axis of said hand tool, where a tool element is movable by an actuation apparatus between a retracted position generally within the body, and an extended operative position wherein the tool element extends through the axial opening and chuck, characterized by said hand tool further having a post, the post being independent of the actuation apparatus, for blocking said tool element against retraction when in said operative position, said post being laterally flexible to a position where it no longer blocks said tool element when retraction is desired, wherein said post is a generally axial post positioned generally on said axis and wherein said actuation apparatus includes an actuation arm having an angled slot for displacing said axial post, retraction of said actuation arm causing said actuation arm to displace laterally by virtue of said angled slot which engages a pin on said tool element, said actuation arm positioned so as to contact said axial post when so displaced laterally, to displace said axial post away from said axis to permit retraction of said tool element.

2. A hand tool as in claim 1, wherein said axial post is biased towards said axis but flexible away from said axis.

3. A hand tool as in claim 1, wherein said axial post is generally rigid, but is mounted flexibly and biased generally towards said axis.

4. A hand tool as in claim 1, wherein the actuation apparatus assists in retracting and extending said tool elements.

5. A hand tool as in claim 4, wherein said actuation apparatus further comprises an actuator button slidable on an outer surface of said body, extending in a slot in said body, said actuator button connecting to said actuation arm for displacing said axial post.

6. A hand tool as in claim 1, comprising a plurality of said tool elements each independently movable between said retracted and extended operative positions.

7. A hand tool as in claim 1, wherein said hand tool is a multiple-bit driver, and wherein at least one of said tool elements comprises a screwdriver bit.

8. A hand tool as in claim 1, wherein the chuck comprises a stop for blocking further extensions of said tool element once the tool element is in the operative position.

* * * * *